US005181044A

United States Patent [19]

Matsumoto et al.

[11] Patent Number: 5,181,044

[45] Date of Patent: Jan. 19, 1993

[54] TOP LOADED ANTENNA

[75] Inventors: Kazuhiro Matsumoto, Hirakata; Masayuki Matsuo, Neyagawa; Naoyuki Noda, Hakusan, all of Japan

[73] Assignee: Matsushita Electric Works, Ltd., Osaka, Japan

[21] Appl. No.: 611,498

[22] Filed: Nov. 13, 1990

[30] Foreign Application Priority Data

| | | | |
|---|---|---|---|
| Nov. 15, 1989 | [JP] | Japan | 1-132803[U] |
| Nov. 15, 1989 | [JP] | Japan | 1-297079 |
| Aug. 8, 1990 | [JP] | Japan | 2-84423[U] |
| Aug. 8, 1990 | [JP] | Japan | 2-210840 |

[51] Int. Cl.[5] ..... H01Q 9/00; H01Q 1/32

[52] U.S. Cl. ..... 343/752; 343/713; 343/700 MS

[58] Field of Search ..... 343/752, 711, 712, 713, 343/749, 828, 829, 830, 846, 848, 700 MS

[56] References Cited

U.S. PATENT DOCUMENTS

| | | | |
|---|---|---|---|
| 2,418,961 | 4/1947 | Wehner | 343/889 |
| 3,427,624 | 2/1969 | Wanselow et al. | 343/752 |
| 3,838,429 | 9/1974 | Reggia | 343/752 |
| 3,967,276 | 6/1976 | Goubau | 343/752 |
| 4,201,989 | 5/1980 | Czerwinski | 343/715 |
| 4,443,803 | 4/1984 | DeSantis et al. | 343/749 |
| 4,821,040 | 4/1989 | Johnson et al. | 343/713 |
| 4,851,859 | 7/1989 | Rappaport | 343/846 |

FOREIGN PATENT DOCUMENTS

| | | |
|---|---|---|
| 0376643 | 7/1990 | European Pat. Off. . |
| 59-183502 | 10/1984 | Japan . |

*Primary Examiner*—Rolf Hille
*Assistant Examiner*—Hoanganh Le
*Attorney, Agent, or Firm*—Stevens, Davis, Miller & Mosher

[57] ABSTRACT

A top loaded antenna comprises a spaced pair of top load plate and a ground plate. A matching element integrally formed with a feedline and a shortline is disposed between the top plate and the ground plate for coupling between the plates, eliminating the necessity of separately and individually coupling the feedline element and shortline element to the plates.

15 Claims, 9 Drawing Sheets

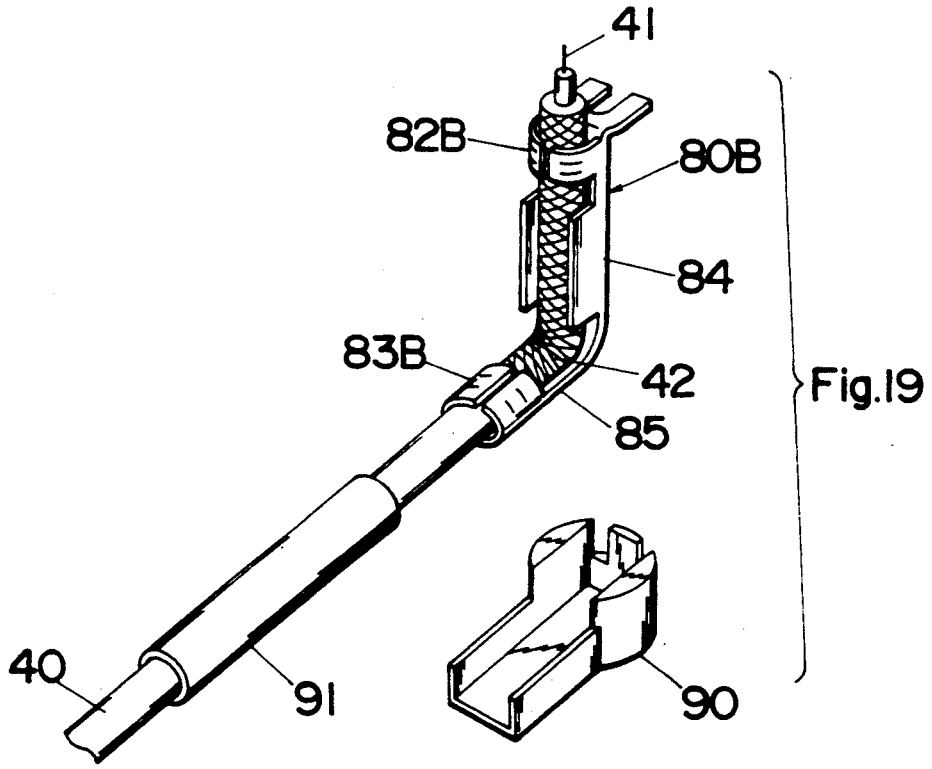
Fig.19
Fig.20
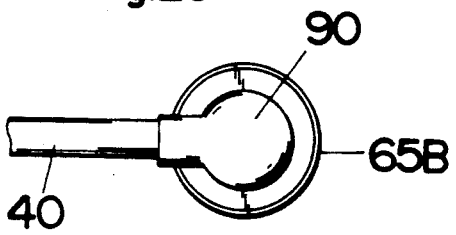

TOP LOADED ANTENNA

BACKGROUND OF THE INVENTION

1. Field of the Invention

The present invention is directed to a top loaded antenna, and more particularly to a small top loaded antenna suitable for use on a vehicle.

2. Description of the Prior Art

In the field of radio systems for transmission to and from moving vehicles such as automobiles and for position detection thereof, a small top loaded antenna has been noted because of its omni-directional characteristic as well as of being readily mounted on the roof of the vehicle. As shown in FIG. 1, a typical prior art top loading antenna comprises a top load plate 1 of conductive metal, a ground plate 2 also of conductive metal, a shortline 3 shorting between the top load plate 1 and the ground plate 2, and a feedline 4 connected between the top load plate 1 and a feeding cable 5. As seen in the prior art top load antenna, the shortline 3 and the feedline 4 are provided as separate members in the form of metal rods, and are accordingly coupled to the top load plate 1 and the ground plate 2 separately by being welded or screwed thereto. This involves duplicate steps of coupling operations to thereby complicate the manufacture and raise manufacturing cost.

SUMMARY OF THE INVENTION

The above problem has been eliminated in the present invention which provides an improved top loaded antenna. The antenna in accordance with the present invention comprises a spaced pair of a top load plate and ground plate, and a matching element interposed between the plates for coupling therebetween. The matching element is of a unitary construction integrally formed with a feedline and a shortline such that the feedline and the shortline can be coupled simultaneously in the antenna structure by a single operation of coupling the matching element between the top load and ground plates.

Accordingly, it is a primary object of the present invention to provide an improved top loaded antenna which is simple in structure and is capable of lowering manufacturing cost.

Preferably, the ground plate is provided as a metal sheet having the matching element which is struck from to be integral therewith and bent towards the top load plate. Alternatively, the top load plate may be in the form of a metal sheet integrally formed with the matching element which is struck from and integral therewith. With this structure of forming the matching element as an integrally struck or lanced member from a portion of the top load plate or ground plate, it is possible to further simplify the coupling operation of the matching element to improve manufacture efficiency, which is therefore another object of the present invention.

Further, the matching element may be provided as a printed board with a conductive pattern which defines the feedline and the shortline. This is advantageous to give a precise pattern to the feedline and the shortline by the printing technique so as to assure consistent antenna characteristics. The conductive pattern of the matching element may form a capacitive element or inductive element in order to have desired impedance matching.

It is therefore a further object of the present invention to provide an improved top loaded antenna which is capable of exactly determining antenna characteristics at the matching element by printing board techniques.

In a preferred embodiment, the top load plate is formed as a printed board with a top load defining a conductive layer. In addition to that the top load conductive layer can be readily configured into a desired configuration by an etching technique, the conductive layer can be easily formed with an additional removable strip or strips which are selectively removed in order to effect frequency matching, which is therefore a further object of the present invention.

Instead of forming the top load plate as a printed board, it is equally possible to form the ground plate as a printed board.

The present invention also discloses other advantageous features with regard to a mounting structure of the top loaded antenna on a supporting panel such as a roof of a vehicle. The top loaded antenna is accommodated in a radome or housing to be placed on the panel with an opening through which an antenna cable is routed from the antenna to the underside of the panel for connection to a corresponding receiver or transmitter device. Projecting from a housing bottom is a tube which is inserted into the opening to pass therethrough the antenna cable. The tube is provide at its end located underside of the panel with angle means for guiding the antenna cable in an angled direction to an axis of the tube so as to extend the cable along the panel, facilitating the cable routing in a limited space below the panel. This is most advantageous for mounting the antenna on the roof of a vehicle as it does not require to forcibly bend the cable of relatively stiff nature by hand in a limited space under the roof of the vehicle.

These and still other objects and advantageous features of the present invention will become more apparent from the following description of the embodiments when taken in conjunction with the attached drawings.

BRIEF DESCRIPTION OF THE DRAWINGS

FIG. 19 is a perspective view of a holder utilized to grip an antenna cable in the structure of FIG. 18;

FIG. 20 is a bottom view of a cap utilized in combination with the above holder;

DETAILED DESCRIPTION OF THE EMBODIMENTS

Figure 1:
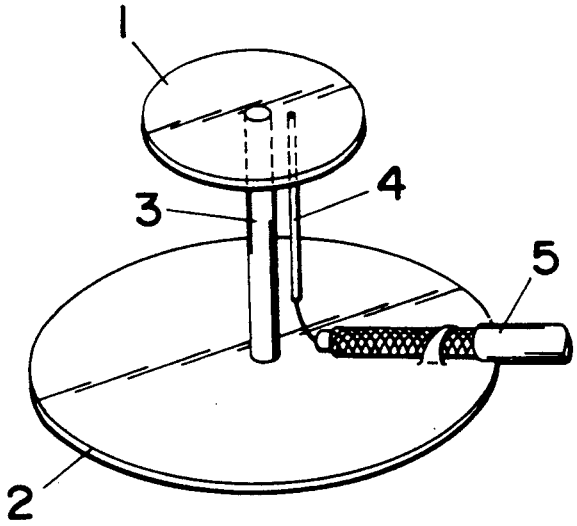
Fig.1 PRIOR ART
FIG. 1 is a schematic view of a typical prior art top loaded antenna.
Figure 2:
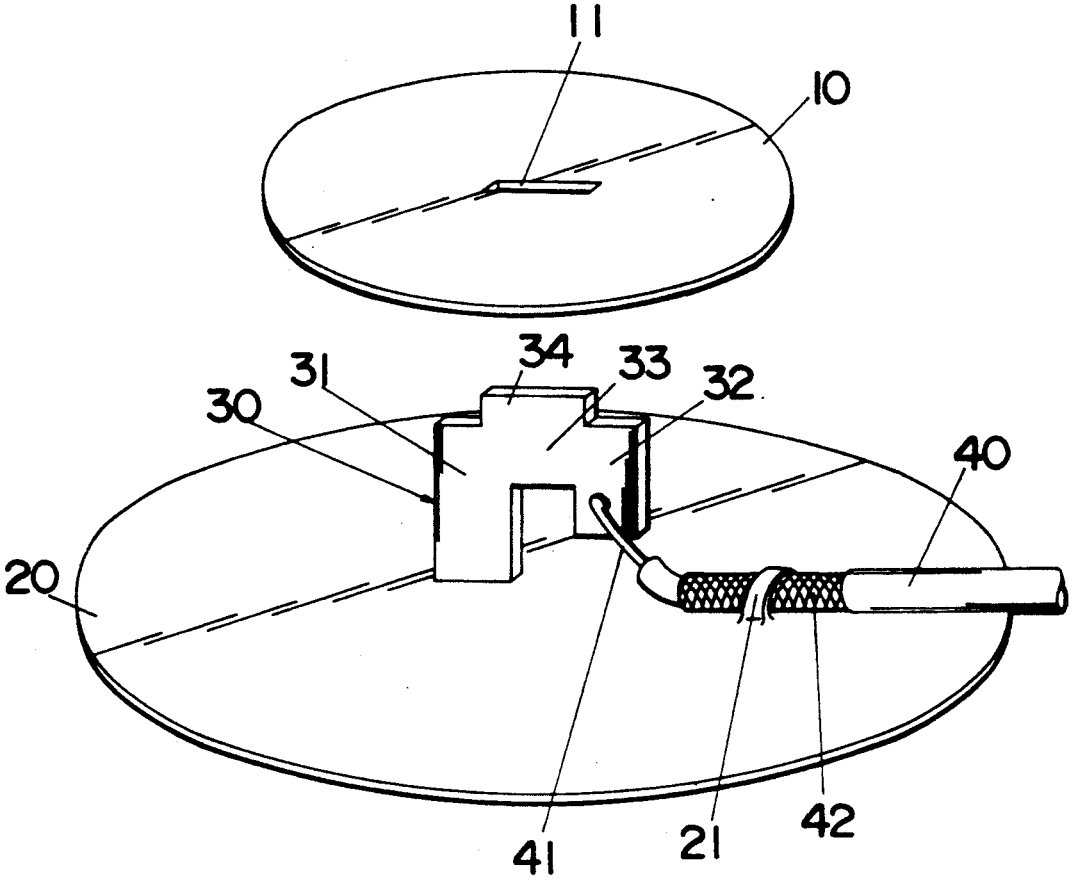
FIG. 2 is an exploded perspective view of a top loaded antenna in accordance with a first embodiment of the present invention.

Referring now to FIG. 2, there is shown a top loaded antenna in accordance with a first embodiment of the present invention. The antenna shown in the figure is configured to cover a UHF frequency of 900 MHz band, and comprises a top load plate or disk 10 of 30 mm radius, a ground plate 20 of 50 mm radius, and a matching element 30. These components are made from a conductive metal such as a steel or the like. The matching element 30 is struck from the metal plate to have a 15 mm long shortline 31 and a 10 mm long feedline 32 which extend in parallel relation to one another and are joined at the upper ends by a bridge segment 33 with an upwardly projecting stud 34. The thus formed matching element 30 is held upright between the ground plate 20 and the top load plate 10 with the lower end of the shortline 31 welded, soldered, or staked to the ground plate 20, and with the stud 34 inserted into a corresponding slot 11 and being welded or soldered thereto. In this manner, the assembling of the top loaded antenna requires only two coupling steps at the upper and lower ends of the matching element 30. An antenna cable 40, which is a coaxial cable, is coupled at its center conductor 41 to the lower end of the feedline 32 and at its outer conductor 42 to the ground plate 20 by a lanced finger 21 which is struck from a portion of the ground plate 20 and is bent over the outer conductor 42 for securement of the cable 40 on the ground plate 20.

Figure 3:
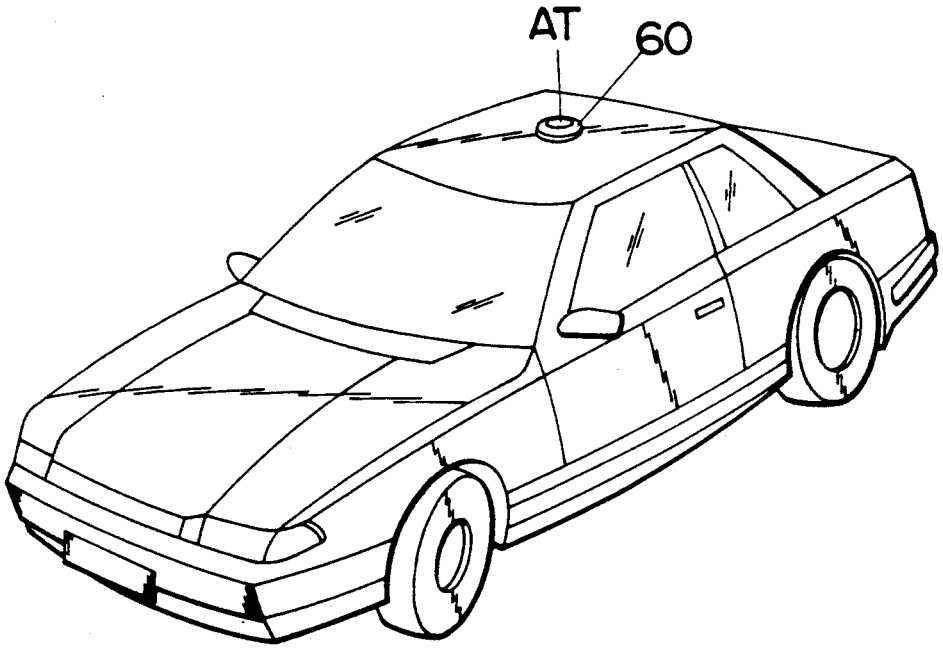
FIG. 3 is a schematic view illustrating one typical application of the antenna on the roof of a vehicle for radio transmission.

As shown in FIG. 3, the top loaded antenna AT of the above structure is utilized, for example, to be mounted on the roof of an automobile as being accommodated in a corresponding radome 60 for radio transmission in a positioning or communication system.

Figure 4:
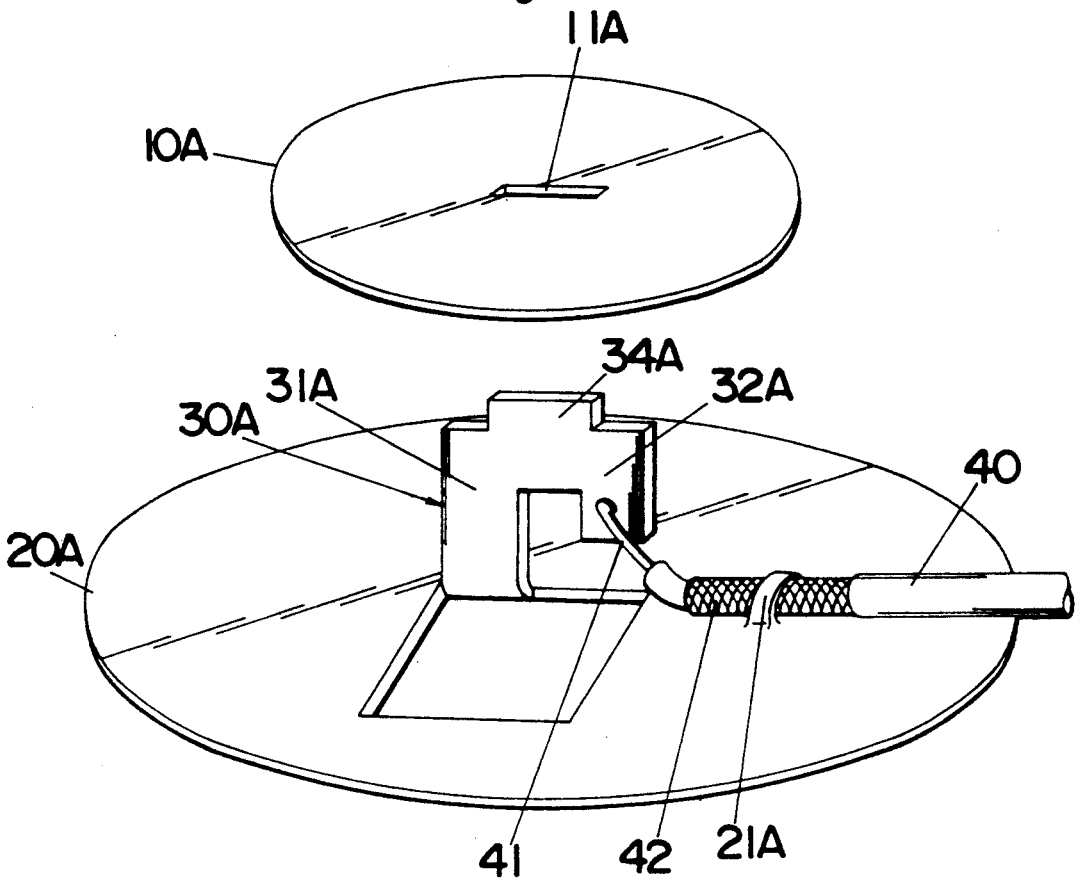
FIG. 4 is an exploded perspective view of a top loaded antenna in accordance with a second embodiment of the present invention.

FIG. 4 shows a top loaded antenna in accordance with a second embodiment of the present invention which is identical to the above first embodiment except that a matching element 30A is an integral member struck from a ground plate 20A. Like parts are designated by like numerals as employed in the first embodiment plus a suffix letter of "A". With this structure of forming the matching element 30A integral with the ground plate 20A, the antenna can be assembled simply by coupling the matching element 30A only at its top end to a top load plate 10A in the like manner as in the first embodiment. Thus, the assembly can be further simplified.

Figure 5:
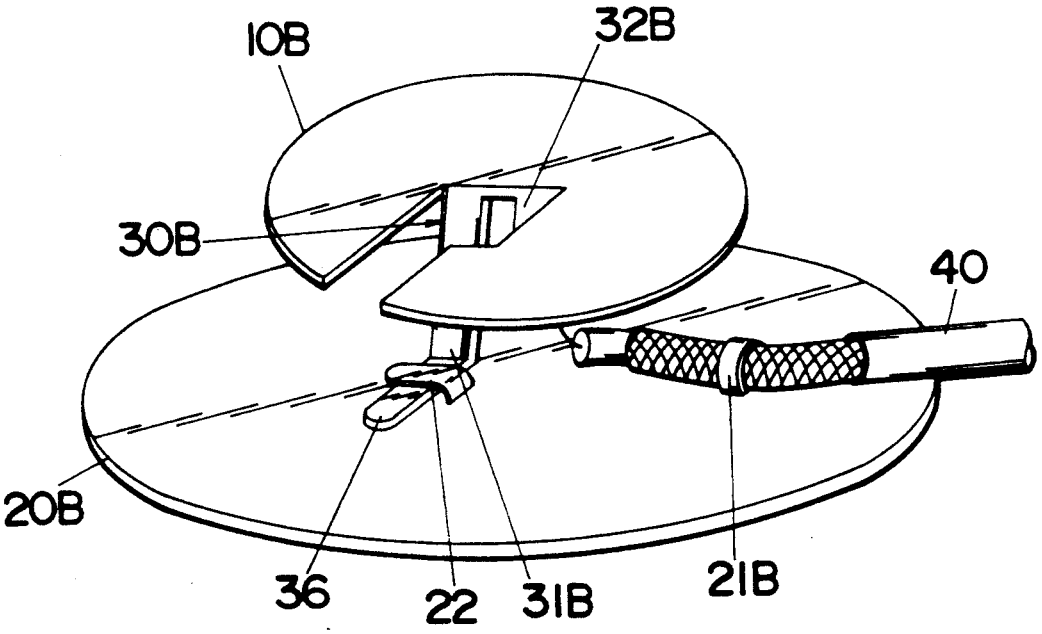
FIG. 5 is a perspective view of a top loaded antenna in accordance with a third embodiment of the present invention.
Figure 6:
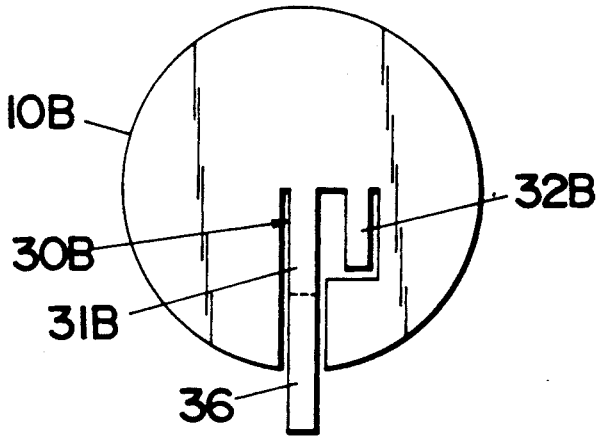
FIG. 6 is a plan view of a top load plate of the antenna of FIG. 5.
Figure 7:
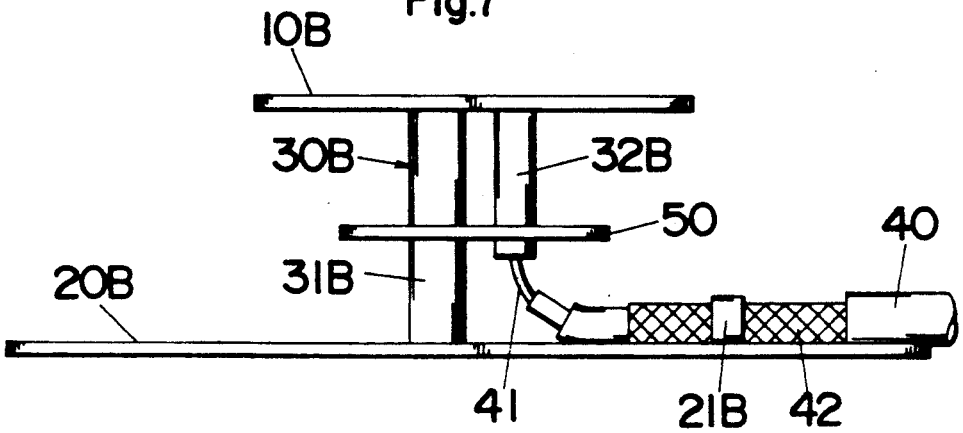
FIG. 7 is a side view of a top loaded antenna of FIG. 5 with a spacer.
Figure 8:
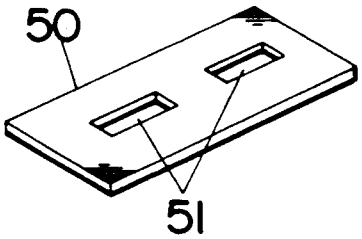
FIG. 8 is a perspective view of the spacer of FIG. 7.

FIGS. 5 and 6 show a third embodiment of the present invention which is characterized to have a matching element 30B which is integral member struck from a top load plate 10B. The other structures are identical to the first embodiment. Therefore, like parts are designated by like numerals with a suffix letter of "B". For facilitating the coupling of the matching element 30B to a ground plate 20B, the matching element 30B is formed with an additional leg 36 which is an extension of a shortline 31B to be bent against the ground plate 20B and engaged with a hook 22 extending integrally from the ground plate 20B. As shown in FIGS. 7 and 8, a fixture plate 50 with spaced holes 51 may be added to keep the shortline 31B and feedline 32B at a fixed interval by inserting the shortline 31B and feedline 32B respectively into the holes 51.

Figure 9:
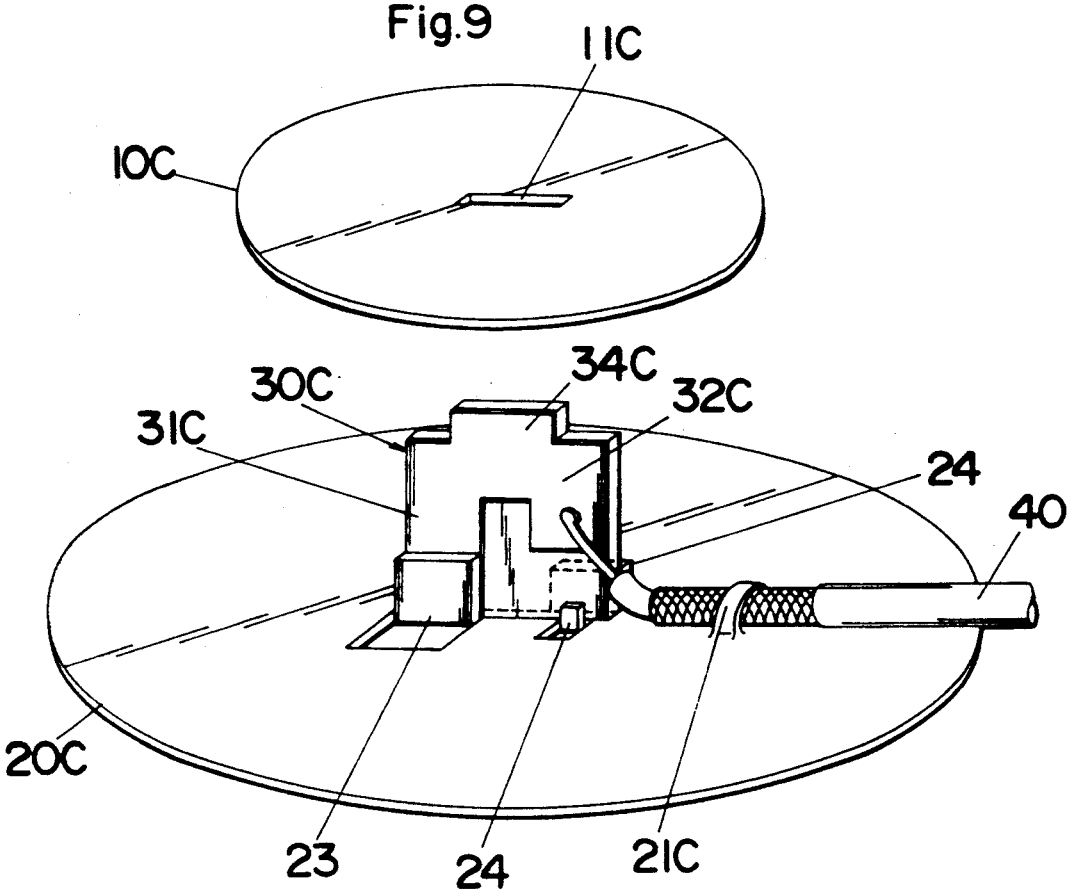
FIG. 9 is an exploded perspective view of a top loaded antenna in accordance with a fourth embodiment of the present invention.

FIG. 9 shows a top loaded antenna in accordance with a fourth embodiment of the present invention which is characterized to have a matching element 30C in the form of a printed board with a conductor pattern on a dielectric substrate. The conductor pattern defines like shortline 31C and feedline 32C. A ground plate 20C of this embodiment is formed with pairs of upwardly bent tabs 23 and 24 which are struck therefrom and into which the lower end of the matching element 30C are fitted to be held in upright position. The upper end of the printed board 30C is formed also with a stud 34C for electrical and mechanical coupling into a slot 11C of a top plate 10C.

Figure 10A:
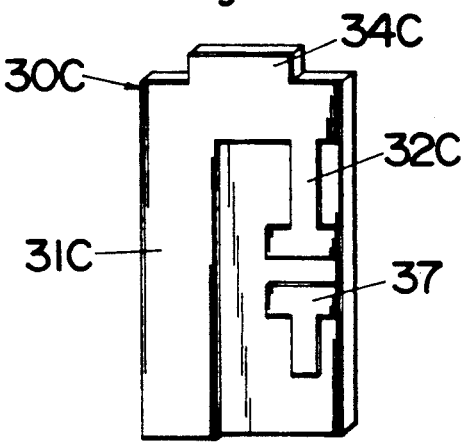
FIGS. 10A and 10B illustrate conductive patterns formed on a matching element of the antenna of FIG. 9 to include capacitive and inductive elements, respectively.
Figure 10B:
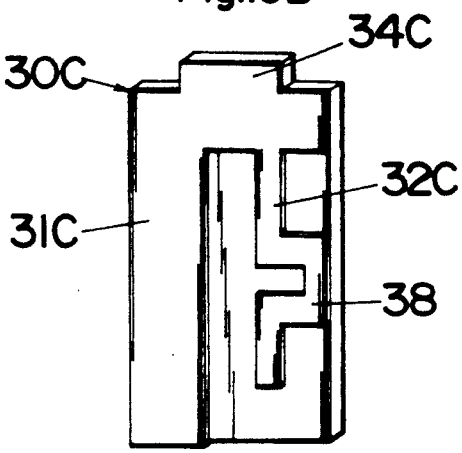

As shown in FIGS. 10A and 10B, the conductor pattern of the printed board 30C may additionally provide a capacitive element 37 [FIG. 10A] or inductive element 38 [FIG. 10B] in connection with the feedline 32C in order to obtain desired antenna characteristics.

Figure 11:
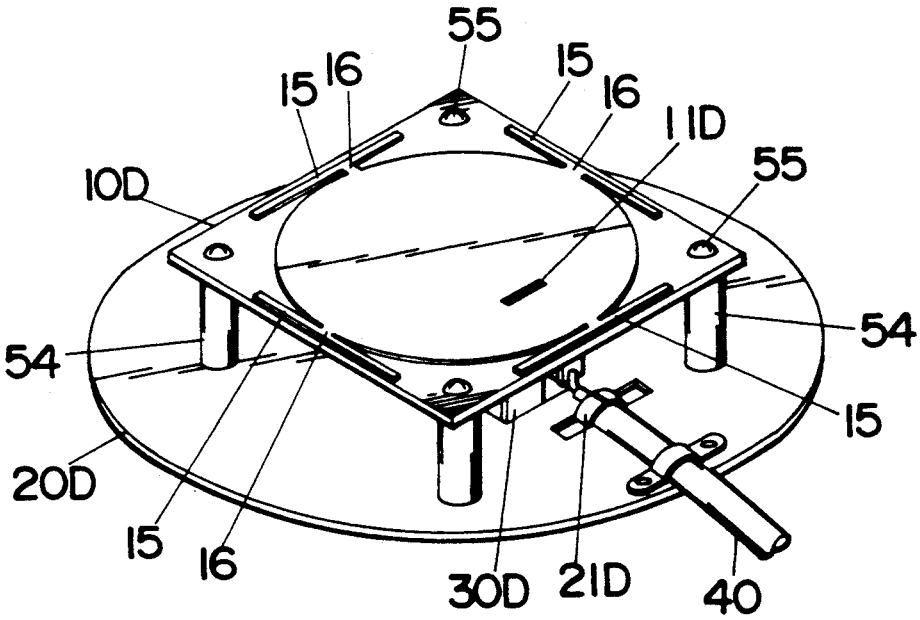
FIG. 11 is a perspective view of a top loaded antenna in accordance with a fifth embodiment of the present invention.
Figure 12:
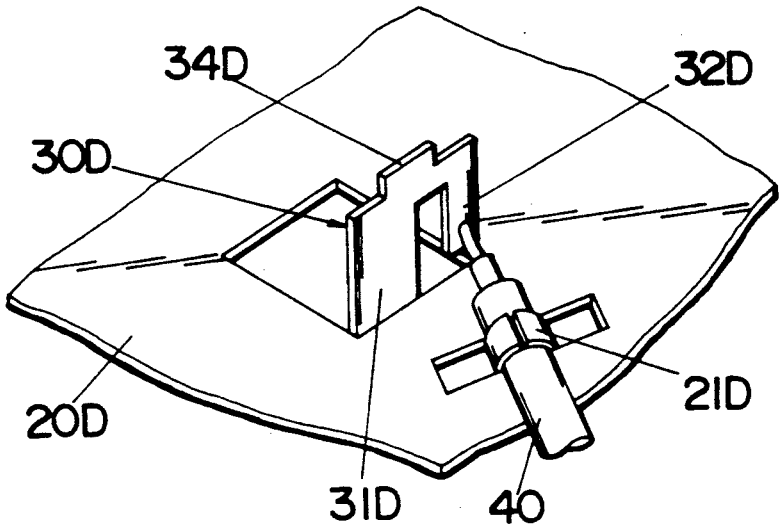
FIG. 12 is a perspective view of a portion of the antenna of FIG. 11.

FIGS. 11 and 12 show a fifth embodiment of the present invention which is identical to the second embodiment except that a top load plate 10D is fabricated in the form of a printed board having a generally disc-shaped top load conductor pattern on a square dielectric substrate. Like numerals are employed with a suffix letter of "D". A matching element 30D struck from a ground plate 20D is coupled to the top load plate 10D with a stud 34D fitted into a slot 11D of the top load plate 10D in the like manner as in the second embodiment. The printed board 10D is held spaced from a ground plate 20D also by means of posts 54 With screws 55. In this embodiment, the conductor pattern of the top load plate 10D includes additional strips 15 arranged outside of the top load forming disc. These strips are each connected to the disc through a narrow breakable neck 16 at which the strip 15 can be detached from the top load defining disc. Thus, it is easy to effect frequency matching by selectively removing the strips 15. Although the strips 15 are illustrated in the figure to have substantially the same size, they may be of differing sizes for delicate frequency matching purposes.

Figure 13:
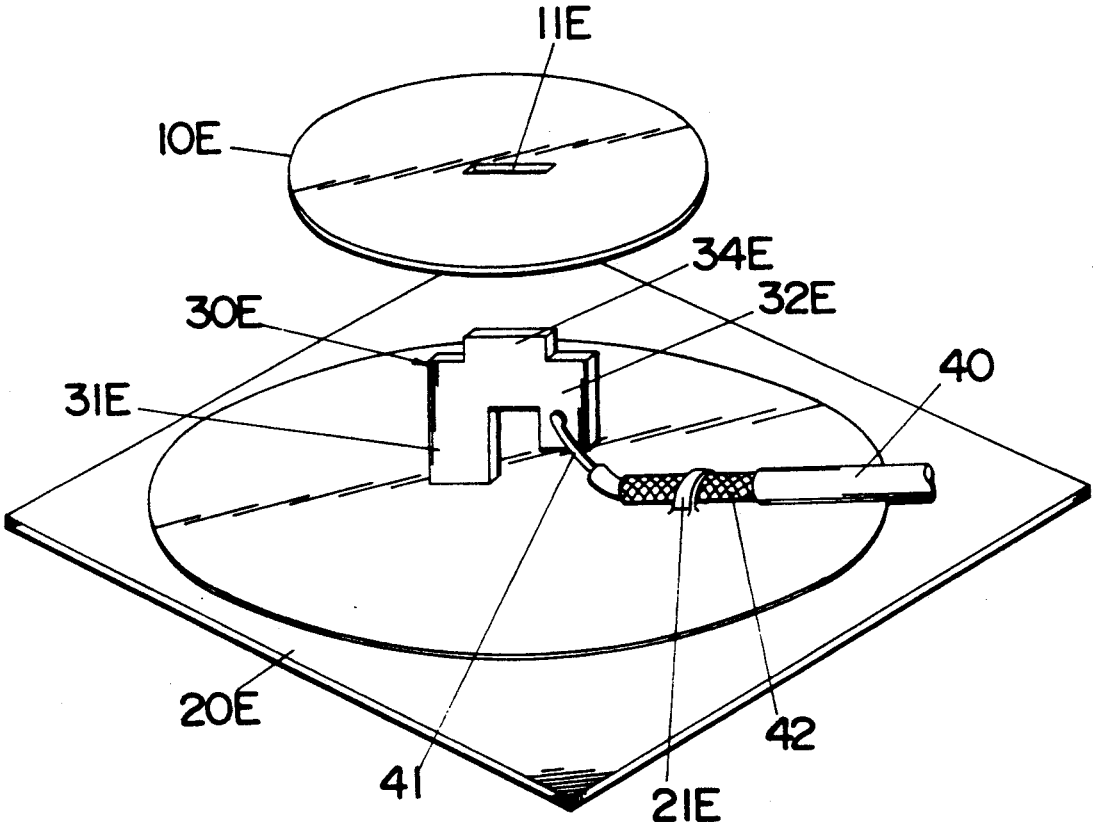
FIG. 13 is a perspective view of a top loaded antenna in accordance with a sixth embodiment of the present invention.

Further, as shown in FIG. 13 which is a sixth embodiment of the present invention, a ground plate 20E may be provided in the form of a printed board with a disc-shaped conductor on a square substrate. The other structures are identical to the first embodiment, therefore like parts are designated by like numerals with a suffix letter of "E".

Figure 14:
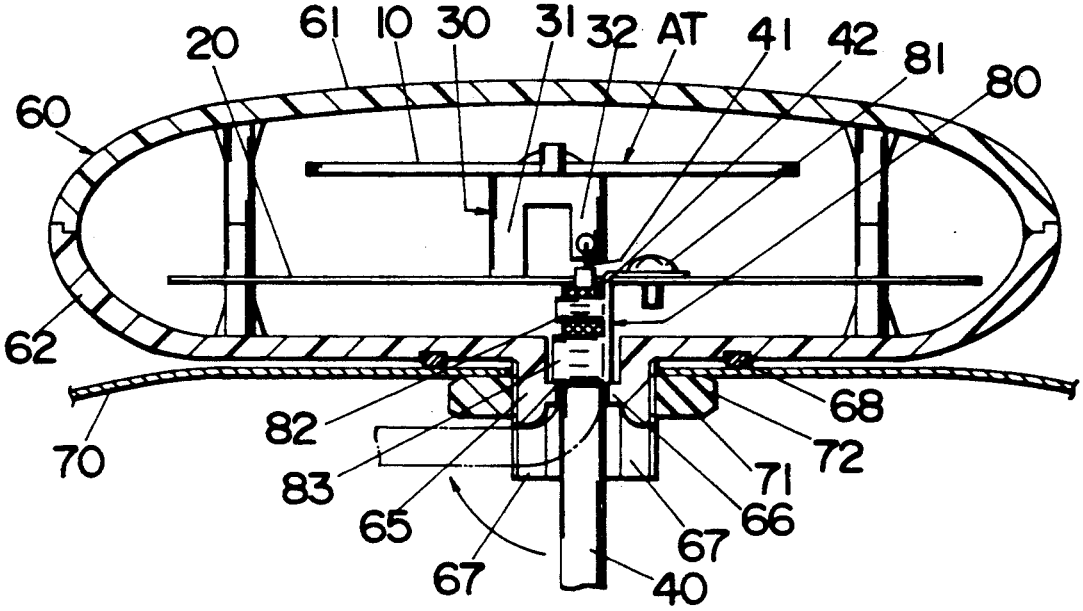
FIG. 14 is a sectional view of a mounting structure of the top loaded antenna on the roof of the vehicle.
Figure 15:
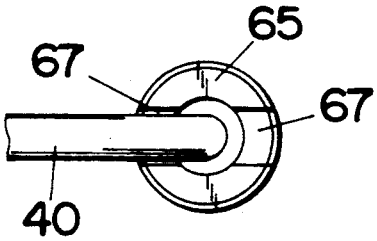
FIG. 15 is a bottom view of a portion of a housing accommodating the top loaded antenna as viewed from the underside of a roof panel of the vehicle.
Figure 16:
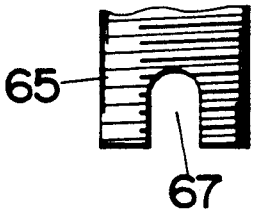
FIG. 16 is partial view of a tube projecting downwardly from the housing.
Figure 22:
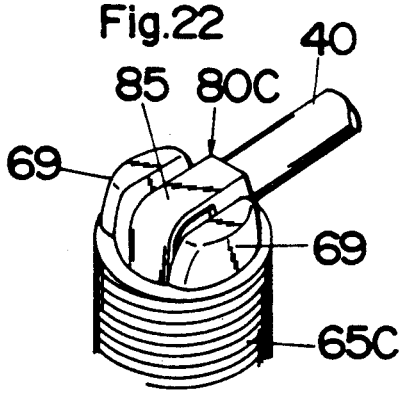
FIG. 22 is a perspective view of a tube projection on the bottom of a housing utilized in the structure of FIG. 21.

Referring to FIGS. 14 and 22, there are shown several mounting structure of the top loaded antenna AT on top or roof of the vehicle, for example, with the use of a radome or housing accommodating the antenna. The housing 60 of FIG. 14 are of low-profile flat configuration composed of upper and lower halves 61 and 62 secured together by means of screws or the like. The housing 60 is formed at its bottom with an integrally depending and externally threaded tube 65 for passing therethrough the antenna cable 40. The tube 65 itself extends through an opening 71 of a panel 70 constructing the roof of the automobile for securing the housing 60 on top of the panel 70 by means of a nut 72 screwed on the tube 65. A holder 80, which is connected at its end to the ground plate 20 by a screw 81, is provided to grip the connecting end of the antenna cable 40 by means of integrally formed split ring retainers 82 and 83. The tube 65 is formed to have an internal flange 66 for abutment against the lower end of the holder 80 so as to confine the holder 80 in the housing 10 and effect strain relief of the cable 40. A seal ring 68 is fitted between the bottom of the housing 10 and the panel 70 around the tube 65 to effect water-tight sealing thereat. As shown in FIGS. 15 and 16, the tube 65 is formed in its lower end with a pair of diametrically opposed slots 67 into which the antenna cable 40 of relative stiff character is allowed to be bent or flexed at a angle to an axis of the tube 65, as shown in chain-dot lines in FIG. 14, such that it can extend along the panel 70 within a limited space therebelow, thereby facilitating the routing of the cable 40 from the antenna AT to a transmitter or receiver device installed in the automobile remote from the antenna AT.

Figure 17:
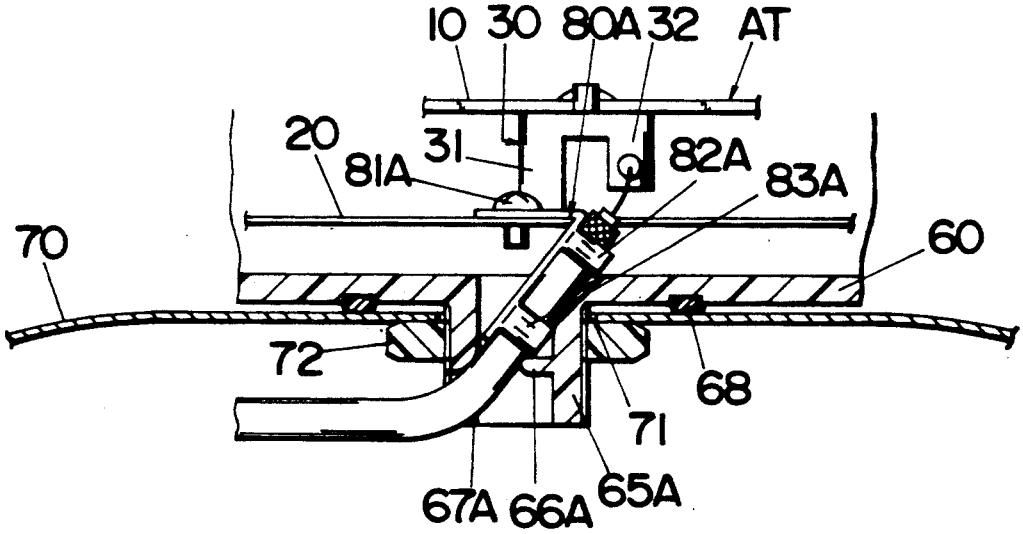
FIG. 17 is a sectional view of another mounting structure of the antenna.

FIG. 17 shows a modification of the above mounting structure in which an angled holder 80A with retainers 82A and 83A is utilized to guide the cable 40 towards the lower end of a tube 65A at about 45° with respect to an upright axis of the tube 65A. A cable guide slot 67A is formed in the lower end of the tube 5A through which the cable 40 extend as being flexed or bent thereat more at an angle of about 45° for guiding the cable 40 in a generally parallel relation to the panel 70, or in a direction substantially perpendicular to the axis of the tube 65A. An internal flange 66A is formed in the tube 65A at a portion diametrically opposed to the slot 67A for abutment with the end of the holder 80A for the same reason as in the structure of FIG. 16.

Figure 18:
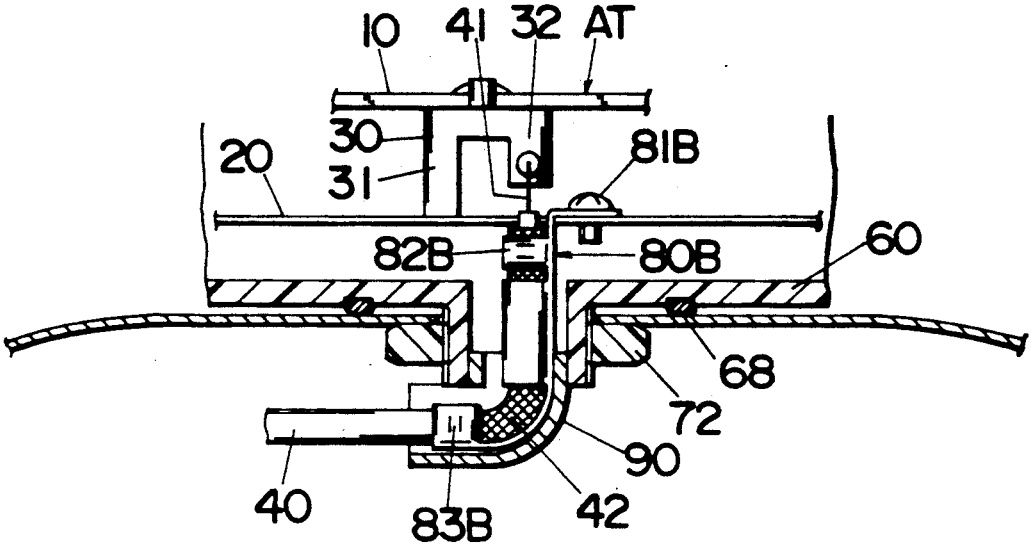
FIG. 18 is a sectional view of a further mounting structure of the antenna.

FIGS. 18 to 20 shows another mounting structure which utilizes a holder 80B having a generally L-shaped grip with a vertical segment 84 and a horizontal segment 85 including split ring retainers 82B and 83B, respectively. The holder 80B is secured at its upper end to the ground plate 20 by a screw 81B and extends through a tube 65B in such a manner as to project the horizontal segment 85 therebelow. Whereby, the cable 40 is guided along the horizontal segment to extend in a direction generally perpendicular to the upright axis of the tube 65B. An electrically insulating plastic cap 90 is fitted to the lower end of the tube 65B for covering the horizontal segment 85 and the portion of the cable 40 held thereat. Further, as shown in FIGS. 19 and 20, an insulating sheath 91 is fitted over the cable 40 and extend into a groove of the cap 90 to conceal the connection of the cable 40 to the horizontal segment 85.

Figure 21:
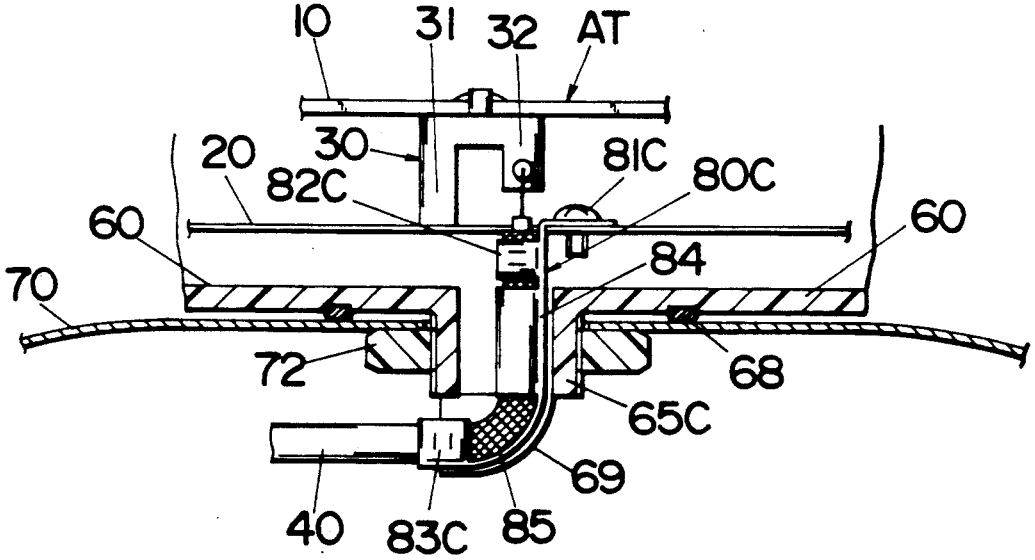
FIG. 21 is a sectional view of a still further mounting structure of the antenna.
Figure 23:
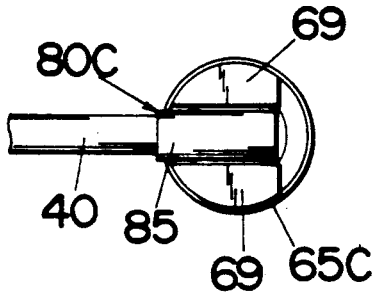
FIG. 23 is a bottom view of the tube with an antenna cable extended therefrom.

FIGS. 21 to 23 show a modification of the above mounting structure in which, a pair of guard walls 69 depends from the lower end of a like tube 65C so as to conceal therebetween the horizontal segment 85 of the holder 80C, instead of using the cap 90.

What is claimed is:

1. A top-loaded antenna comprising:

a top load plate;

a ground plate spaced from said top load plate; and a matching element integrally provided with feedline means and shortline means, said matching element coupling said top load plate to said ground plate, said matching element being made in the form of a printed board with conductive patterns which define said feedline means and said shortline means, said feedline means terminating with one end spaced from said ground plate to define thereat a coupling end for physical and electrical connection to a feed cable.

2. A top loaded antenna as set forth in claim 1, wherein said top load plate is formed as a printed board with a top load plane defining conductive layer.

3. A top loaded antenna as set forth in claim 1, wherein said ground plate is formed as a printed board with a ground plane defining conductive layer.

4. A top loaded antenna comprising:

a top load plate;

a ground plate spaced from said top load plate; and a matching element integrally provided with feedline means and shortline means, said matching element coupling said top load plate to said ground plate wherein said ground plate is in the form of a metal sheet and said matching element is cut out from said ground plate and remains integral therewith and is bent towards said top load plate, said top load plate being secured thereto.

5. A top loaded antenna comprising:

a top load plate;

a ground plate spaced from said top load plate; and a matching element integrally provided with feedline means and shortline means, said matching element coupling said top load plate to said ground plate wherein said top load plate is in the form of a metal sheet and said matching element is cut out from top load plate and remains integral therewith and is bent towards said ground plate with said ground plate being secured thereto.

6. A top loaded antenna comprising:

a top load plate;

a ground plate spaced from said top load plate; and a matching element integrally provided with feedline means and shortline means, said matching element coupling said top load plate to said ground plate wherein said matching element is in the form of a printed board with a conductive pattern defining said feedline means and shortline means and wherein said conductive pattern includes a capacitive element.

7. A top loaded antenna comprising:

a top load plate;

a ground plate spaced from said top load plate; and a matching element integrally provided with feedline means and shortline means, said matching element coupling said top load plate to said ground plate wherein said matching element is in the form of a printed board with a conductive pattern defining said feedline means and shortline means and wherein said conductive pattern includes an inductive element.

8. A mounting structure of a top loaded antenna on a panel having a mount open, which comprises:

said top loaded antenna comprising;

a top load plate;

a ground plate spaced from said top load plate; and a matching element integrally provided with feedline means and shortline means, said matching element coupling said top load plate to said ground plate;

a housing accommodating said antenna to be placed on said panel, said housing having a tube projecting on a housing bottom into said opening of said panel for routing therethrough an antenna cable;

angle means provided at the end of said tube for guiding said antenna cable in an angle direction to an axis of said tube, said angle means being capable of bending said antenna cable at such an angle that said antenna cable can be guided along said panel in a direction substantially perpendicular to an axis of said tube.

9. A mounting structure for a top loaded antenna on a panel having a mount opening comprising:

said top loaded antenna comprising;

a top load plate;

a ground plate spaced from said top load plate; and a matching element integrally provided with feedline means and shortline means, said matching element coupling said top load plate to said ground plate;

a housing accommodating said antenna to be placed on said panel, said housing having a tube projecting on a housing bottom into said opening of said panel for routing therethrough an antenna cable;

angle means provided at the end of said tube for guiding said antenna cable in an angle direction to an axis of said tube wherein said tube is formed in its peripheral wall with at least one slot which defines said angle means.

10. A mounting structure for a top loaded antenna comprising:

said top loaded antenna comprising;

a top load plate;

a ground plate spaced from said top load plate; and a matching element integrally provided with feedline means and shortline means, said matching element coupling said top load plate to said ground plate;

a housing accommodating said antenna to be placed on said panel, said housing having a tube projecting on a housing bottom into said opening of said panel for routing therethrough an antenna cable;

angle means provided at the end of said tube for guiding said antenna cable in an angle direction to an axis of said tube wherein said angle means comprises a generally L-shaped holder with a vertical leg and a horizontal leg, said vertical leg being secured within said housing to said antenna and extending into said tube, said horizontal leg extending out of said tube in an angled relation to the axis of said tube for guiding said antenna cable in the direction of said horizontal leg on the underside of said panel.

11. A mounting structure for a top loaded antenna on a panel having a mount opening comprising:

said top loaded antenna comprising;

a top load plate;

a ground plate spaced from said top load plate; and a matching element integrally provided with feedline means and shortline means, said matching element coupling said top load plate to said ground plate;

a housing accommodating said antenna to be placed on said panel, said housing having a tube projecting on a housing bottom into said opening of said panel for routing therethrough an antenna cable;

angle means provided at the end of said tube for guiding said antenna cable in an angle direction to an axis of said tube wherein said angle means comprises a generally L-shaped holder with a vertical leg and a horizontal leg, said vertical leg being secured within said housing to said antenna and extending into said tube, said horizontal leg extending out of said tube in an angled relation to the axis of said tube for guiding said antenna cable in the direction of said horizontal leg on the underside of said panel and further including a cap adapted to the end of said tube to conceal said horizontal leg.

12. A top-loaded antenna comprising:

a top load plate;

a ground plate spaced from said top load plate; and a matching element integrally provided with feedline means and shortline means, said matching element coupling said top load plate to said ground plate, said matching element being in the form of a generally planar sheet cut out from one of said top load plate and said ground plate and remaining integrally attached to the plate from which it was cut and integrally including said feedline means and said shortline means, said feedline means terminating with one end spaced from said ground plate to define thereat a coupling end for physical and electrical connection to a feed cable.

13. A top loaded antenna as set forth in claim 12 wherein said shortline means and said feedline means are positioned side by side on said generally planar matching element.

14. A top-loaded antenna comprising:

a top load plate;

a ground plate spaced from said top load plate; and a matching element integrally provided with feedline means and shortline means, said matching element coupling said top load plate to said ground plate, said matching element being made in the form of a generally planar sheet of a general "U" shape with two legs, one leg being shorter than the other, the longer leg comprising said shortline means and the shorter leg comprising said feedline means terminating with one end spaced from said ground plate to define thereat a coupling end for physical and electrical connection to a feed cable.

15. A top loaded antenna as set forth in claim 14 wherein said top load plate is formed as a printed board with a top load plane defining a conductive layer and said top load conductive layer includes at least one removable strip for frequency matching.

* * * * *